US008052884B2

(12) United States Patent
Sullivan et al.

(10) Patent No.: US 8,052,884 B2
(45) Date of Patent: Nov. 8, 2011

(54) METHOD OF FABRICATING MICROCHANNEL PLATE DEVICES WITH MULTIPLE EMISSIVE LAYERS

(75) Inventors: Neal T. Sullivan, Lunenburg, MA (US); David Beaulieu, Groton, MA (US); Anton Tremsin, Lafayette, CA (US); Philippe De Rouffignac, Cambridge, MA (US); Michael D. Potter, Churchville, NY (US)

(73) Assignee: Arradiance, Inc., Sudbury, MA (US)

( * ) Notice: Subject to any disclaimer, the term of this patent is extended or adjusted under 35 U.S.C. 154(b) by 790 days.

(21) Appl. No.: 12/038,139

(22) Filed: Feb. 27, 2008

(65) Prior Publication Data

US 2009/0215211 A1 Aug. 27, 2009

(51) Int. Cl.
*B31D 3/00* (2006.01)

(52) U.S. Cl. ..... 216/56; 216/25

(58) Field of Classification Search ..... 216/25, 216/56

See application file for complete search history.

(56) References Cited

U.S. PATENT DOCUMENTS

| | | | | |
|---|---|---|---|---|
| 3,967,001 | A | 6/1976 | Almaula et al. | |
| 4,339,659 | A | 7/1982 | Johnson | |
| 4,555,731 | A | 11/1985 | Zinchuk | |
| 4,780,395 | A | 10/1988 | Saito et al. | |
| 4,912,314 | A | 3/1990 | Sink | |
| 5,086,248 | A | 2/1992 | Horton et al. | |
| 5,205,902 | A | 4/1993 | Horton | |
| 5,319,189 | A | 6/1994 | Beauvais et al. | |
| 5,378,960 | A | 1/1995 | Tasker et al. | |
| 5,726,076 | A * | 3/1998 | Tasker et al. | 438/20 |
| 6,452,184 | B1 | 9/2002 | Taskar et al. | |
| 6,828,714 | B2 | 12/2004 | Downing et al. | |
| 6,943,344 | B2 | 9/2005 | Cornish et al. | |
| 6,946,197 | B2 | 9/2005 | Yadav et al. | |
| 7,026,177 | B2 | 4/2006 | Laprade | |
| 7,183,701 | B2 | 2/2007 | Downing et al. | |
| 2002/0021064 | A1 | 2/2002 | Devoe | |
| 2002/0076507 | A1 * | 6/2002 | Chiang et al. | 427/569 |
| 2002/0088714 | A1 | 7/2002 | Motoi et al. | |
| 2003/0214236 | A1 | 11/2003 | Kaoet et al. | |
| 2005/0184249 | A1 | 8/2005 | Suzuki | |
| 2006/0078679 | A1 | 4/2006 | Elers et al. | |
| 2008/0004670 | A1 | 1/2008 | McVenes et al. | |

OTHER PUBLICATIONS

"Notification of Transmittal of the International Search Report and the Written Opinion of the International Searching Authority, or the Declaration" for PCT/US2009/035012, Jul. 16, 2009, 12 pages, The International Searching Authority/Korean Intellectual Property Office, Seo-gu, Republic of Korea.

(Continued)

*Primary Examiner* — Roberts Culbert

(74) *Attorney, Agent, or Firm* — Kurt Rauschenbach; Rauschenbach Patent Law Group, LLP

(57) ABSTRACT

A method of fabricating a microchannel plate includes defining a plurality of pores extending from a top surface of a substrate to a bottom surface of the substrate where the plurality of pores has a resistive material on an outer surface that forms a first emissive layer. A second emissive layer is formed over the first emissive layer. The second emissive layer is chosen to achieve at least one of an increase in secondary electron emission efficiency and a decrease in gain degradation as a function of time. A top electrode is formed on the top surface of the substrate and a bottom electrode is formed on the bottom surface of the substrate.

25 Claims, 7 Drawing Sheets

OTHER PUBLICATIONS

"Notification of Transmittal of the International Search Report and the Written Opinion of the International Searching Authority, or the Declaration" for PCT/US09/047977, International Searching Authority, Apr. 23, 2010, 11 pages, Seo-gu, Daejeon, Republic of Korea.

"Notification of Transmittal of the International Search Report and the Written Opinion of the International Searching Authority, or the Declaration" for PCT/US09/047950, International Searching Authority, Apr. 21, 2010, 11 pages, Seo-gu, Daejeon, Republic of Korea.

"Notification Concerning Transmittal of International Preliminary Report on Patentability (Chapter I of the Patent Cooperation Treaty)" for PCT/US09/035012, International Bureau of WIPO, Sep. 10, 2010, 7 pages, Geneva, Switzerland.

"Notification Concerning Transmittal of International Preliminary Report on Patentability (Chapter I of the Patent Cooperation Treaty)" for PCT/US09/035017, International Bureau of WIPO, Sep. 10, 2010, 9 pages, Geneva, Switzerland.

Then, A.M., et al., Formation and Behavior of Surface Layers on Electron Emission Glasses, Journal of Non-Crystalline Solids, 1990, pp. 178-187, vol. 120, Elsevier Science Publishers B.V., North Holland.

Elam, J.W., et al., Conformal Coating on Ultrahigh-Aspect-Ratio Nanopores of Anodic Alumina by Atomic Layer Deposition, Chem. Mater., 2003, pp. 3507-3517, vol. 15, American Chemical Society.

Wiza, Joseph Ladislas, Microchannel Plate Detectors, Nuclear Instruments and Methods, 1979, pp. 587-601, vol. 162.

Elam, J.W., et al., Properties of ZnO/AI2O3 Alloy Films Grown Using Atomic Layer Deposition Techniques, Journal of the Electrochemical Society, 2003, G339-G347, vol. 150, No. 6, The Electrochemical Society, Inc.

Notification Concerning Transmittal of International Preliminary Report on Patentability (Chapter I of the Patent Cooperation Treaty) for PCT/US2009/040127, Oct. 21, 2010, 8 pages, The International Bureau of WIPO, Geneva, Switzerland.

Elam, Jeffrey W., et al., Atomic Layer Deposition for the Conformal Coating of Nanoporous Materials, Journal of Nanomaterials, 2006, pp. 1-5, vol. 2006, Hindawi Publishing Corporation.

"Notification of Transmittal of the International Search Report and the Written Opinion of the International Searching Authority, or the Declaration" for PCT/US09/035017, Korean Intellectual Property Office, Jan. 11, 2010, 14 pages, Seo-gu, Republic of Korea.

* cited by examiner

METHOD OF FABRICATING MICROCHANNEL PLATE DEVICES WITH MULTIPLE EMISSIVE LAYERS

FEDERAL RESEARCH STATEMENT

This invention was made with government support under Grant Number HR0011-05-9-0001 awarded by the Defense Advanced Research Projects Agency (DARPA). The Government has certain rights in this invention.

The section headings used herein are for organizational purposes only and should not to be construed as limiting the subject matter described in the present application.

BACKGROUND OF THE INVENTION

Microchannel plates (MCPs) are used to detect very weak signals generated by ions and electrons. For example, microchannel plates are commonly used as electron multipliers in image intensifying devices. A microchannel plate is a slab of high resistance material having a plurality of tiny tubes or slots, which are known as microchannels, extending through the slab. The microchannels are parallel to each other and may be postioned at a small angle to the surface. The microchannels are usually densely distributed. A high resistance layer having high secondary electron emission efficiency is formed on the inner surface of each of the plurality of channels so that it functions as a dynode. A conductive coating is formed on the top and bottom surfaces of the slab comprising the microchannel plate.

In operation, an accelerating voltage is applied across the conductive coatings on the top and bottom surfaces of the microchannel plate. The accelerating voltage establishes a potential gradient between the opposite ends of each of the plurality of channels. Ions and electrons traveling in the plurality of channels are accelerated. These ions and electrons collide against the high resistance layer having high secondary electron emission efficiency, thereby producing secondary electrons. The secondary electrons are accelerated and undergo multiple collisions with the resistance layer. Consequently, electrons are multiplied inside each of the plurality of channels. The electrons eventually pass through the anode end of each of the plurality of channels. The electrons can be detected or can be used to form images on an electron sensitive screen, such as a phosphor screen.

BRIEF DESCRIPTION OF THE DRAWINGS

The invention, in accordance with preferred and exemplary embodiments, together with further advantages thereof, is more particularly described in the following detailed description, taken in conjunction with the accompanying drawings. The drawings are not necessarily to scale, emphasis instead generally being placed upon illustrating principles of the invention.

DETAILED DESCRIPTION

Reference in the specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment.

It should be understood that the individual steps of the methods of the present invention may be performed in any order and/or simultaneously as long as the invention remains operable. Furthermore, it should be understood that the apparatus and methods of the present invention can include any number or all of the described embodiments as long as the invention remains operable.

The present teachings will now be described in more detail with reference to exemplary embodiments thereof as shown in the accompanying drawings. While the present teachings are described in conjunction with various embodiments and examples, it is not intended that the present teachings be limited to such embodiments. On the contrary, the present teachings encompass various alternatives, modifications and equivalents, as will be appreciated by those of skill in the art. Those of ordinary skill in the art having access to the teachings herein will recognize additional implementations, modifications, and embodiments, as well as other fields of use, which are within the scope of the present disclosure as described herein.

The present invention relates to methods for fabricating microchannel plate devices with continuous dynodes exhibiting enhanced secondary electron emission. In various embodiments of the present invention, at least a first and a second emissive layer are fabricated in each of the plurality of channels of the microchannel plates. Most known microchannel plates are fabricated from glass. For example, one common type of microchannel plate is fabricated by forming a plurality of small holes in a glass plate. However, recently microchannel plates have been constructed from semiconductor materials. One skilled in the art will appreciate that the methods of the present invention can be used with any type of microchannel plate including conventional glass microchannel plates, semiconductor microchannel plates, and ceramic microchannel plates.

Figure 1A:
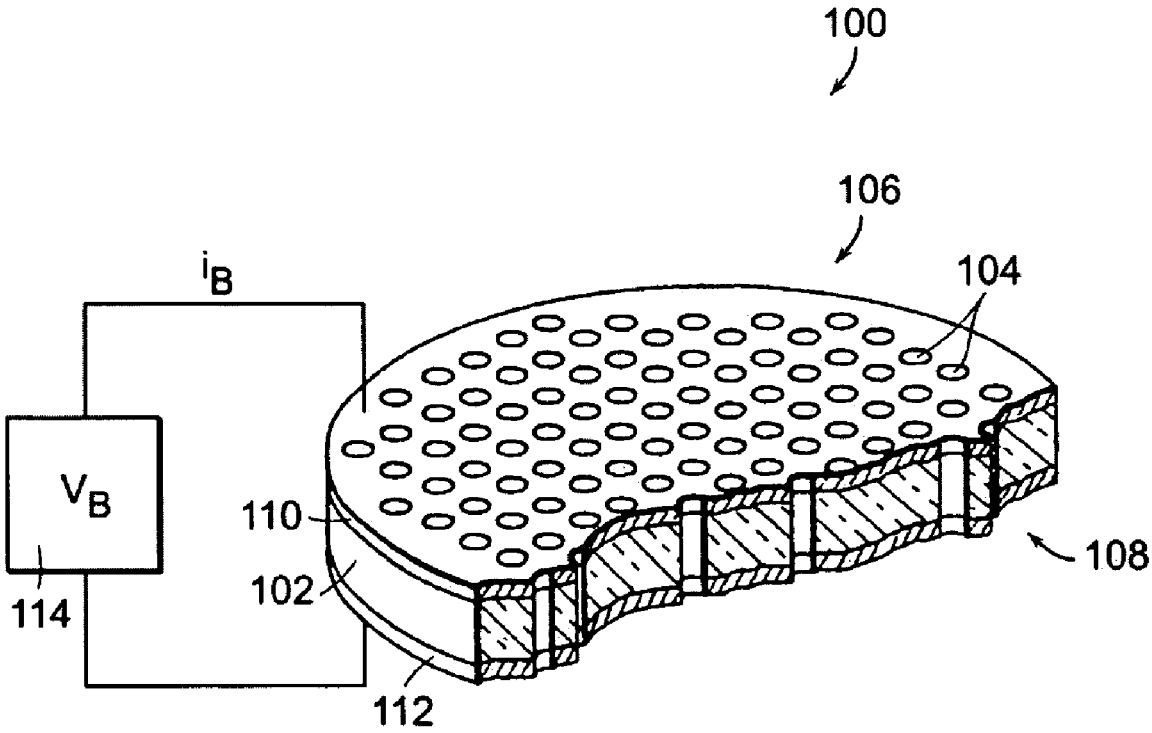
FIG. 1A illustrates a perspective view of a cross section of a microchannel plate with multiple emissive layers fabricated according to the present invention.

FIG. 1A illustrates a perspective view of a cross section of a microchannel plate 100 with multiple emissive layers fabricated according to the present invention. The microchannel plate 100 includes a substrate 102 that defines a plurality of microchannels or pores 104 extending from a top surface 106 of the substrate 102 to a bottom surface 108 of the substrate 102.

Numerous types of substrate materials can be used for the microchannel plate 100. For example, the substrate material can be the same plates of glass fibers that have been used in conventional glass microchannel plates for many years. See, for example, the glass plates described in Microchannel Plate Detectors, Joseph Wiza, Nuclear Instruments and Methods, Vol. 162, 1979, pages 587-601.

Recently, silicon has been used as a substrate for microchannel plates. See, for example, U.S. Pat. No. 6,522,061B1 to Lockwood, which is assigned to the present assignee. Silicon microchannel plates have several advantages compared with glass microchannel plates. Silicon microchannel plates can be more precisely fabricated because the pores can be lithographically defined rather than manually stacked like glass microchannel plates. Silicon processing techniques, which are very highly developed, can be applied to fabricating such microchannel plates. Also, silicon substrates are much more process compatible with other materials and can withstand high temperature processing. In contrast, glass microchannel plates melt at much lower temperatures than silicon microchannel plates. Furthermore, silicon microchannel plates can be easily integrated with other devices. For example, a silicon microchannel plate can be easily integrated with various types of other electronic and optical devices, such as photodectors, MEMS, and various types of integrated electrical and optical circuits. One skilled in the art will appreciate that the substrate material can be any one of numerous other types of insulating substrate materials.

Each of the plurality of pores 104 in the microchannel plate 100 includes at least two emissive layers. Microchannel plates fabricated according to the present invention can include any number of emissive layers formed on the pores. In various embodiments, other resistive layers can be formed on the outer surface of the plurality of pores 104, between emissive layers, and/or on the outer surface of the outer emissive layer. Also, in various embodiments, thin conductive layers can be formed on the outer surface of the plurality of pores 104, between emissive layers, and/or on the outer surface of the outer emissive layer. Various possible resistive and conductive layers are described in more detail in connection with FIG. 1C.

Conductive electrodes 110, 112 are deposited on the top 106 and bottom surface 108 of the microchannel plate 100. The conductive electrodes 110, 112 provide electrical contacts to the plurality of pores 104 in the microchannel plate 100. A power supply 114 is electrically connected to the top 106 and the bottom surface 108 of the microchannel plate 100 so as to provide a bias voltage to the plurality of microchannel plates. The power supply 114 biases the microchannel plate 110 so that each of the plurality of pores 104 functions as a continuous dynode.

Figure 1B:
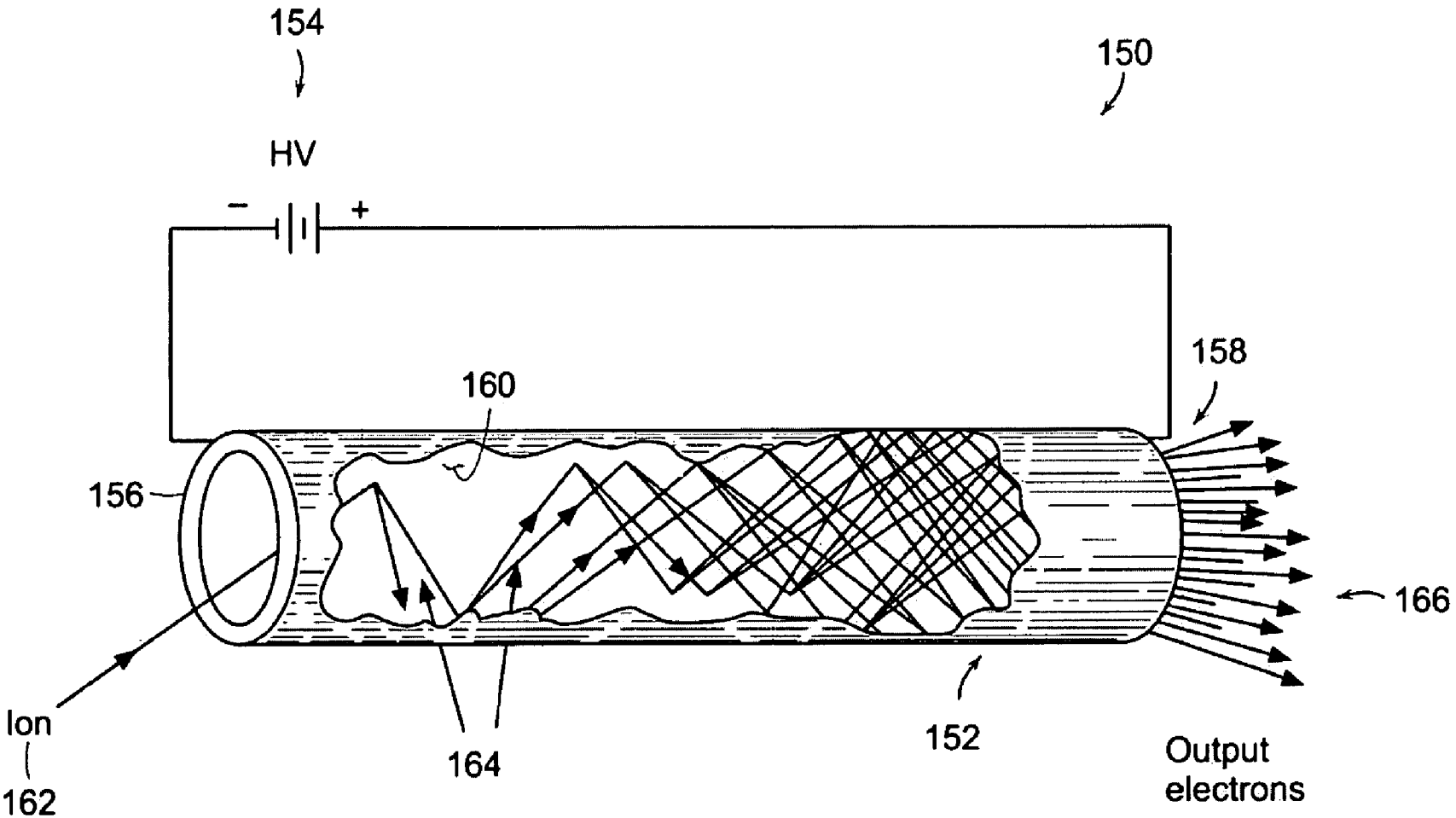
FIG. 1B illustrates a perspective view of a single channel electron multiplier with multiple emissive layers fabricated according to the present invention.

FIG. 1B illustrates a perspective view of a single channel electron multiplier 150 with multiple emissive layers fabricated according to the present invention. The single channel electron multiplier 150 is similar in construction and operation to the microchannel plate 100 that was described in connection with FIG. 1A. However, the single channel electron multiplier 150 includes only one electron multiplication channel 152. Similar single channel electron multiplier devices with a single emissive layer are commercially available.

The single channel electron multiplier 150 includes a power supply 154 having outputs that are electrically connected to a top 156 and bottom surface 158 of the electron multiplier 150. A cut away section of the single channel electron multiplier 150 shows the multiple emissive layers 160. The cut away section also shows an ion 162 generating electron multiplication 164 and the resulting output electrons 166.

Figure 1C:
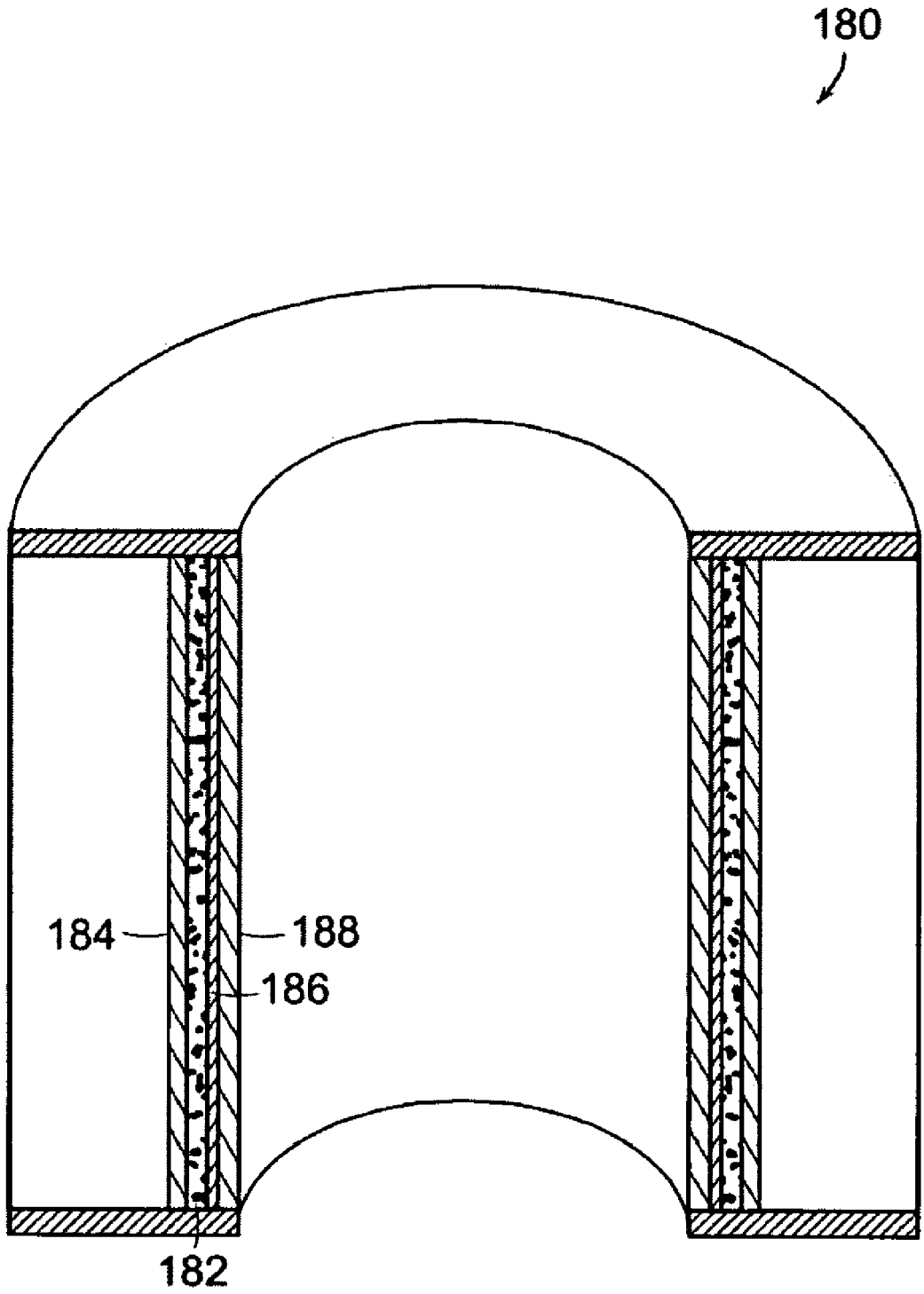
FIG. 1C illustrates a cross section of a single pore of a microchannel plate or single channel electron multiplier fabricated according to the present invention.

FIG. 1C illustrates a cross section of a single pore 180 of a microchannel plate or single channel electron multiplier fabricated according to the present invention. A first emissive layer 182 is formed on the outer surface of the pore 180. The first emissive layer 182 is a resistive material with a relatively high secondary electron emission efficiency. In some embodiments, the first emissive layer 182 is a reduced lead-glass layer, such as the reduced lead-glass layers that are commonly used in conventional microchannel plates. In various other embodiments, the first emissive layer 182 is at least one of $Al_2O_3$, $SiO_2$, MgO, $SnO_2$, BaO, CaO, SrO, $Sc_2O_3$, $Y_2O_3$, $La_2O_3$, $ZrO_2$, $HfO_2$, $Cs_2O$, $Si_3N_4$, $Si_xO_yN_z$, C (diamond), BN, and AlN.

In some embodiments, a thin barrier layer 184 is formed on the outer surface of the pore 180 before the first emissive layer 182 is formed. The thin barrier layer 184 can be used to improve or to optimize secondary electron emission. In addition, the thin barrier layer 184 can be used to passivate the outer surface of the pore 180 to prevent ions from migrating out of the surface of the pore 180. The electrostatic fields maintained within the microchannel plate that move electrons through the pore 180 also move any positive ions that migrate through the pore 180 towards a photocathode or other downstream device or instrument used with the microchannel plate. These positive ions may include the nucleus of gas atoms of considerable size, such as hydrogen, oxygen, and nitrogen. These gas atoms are much more massive than electrons. Such positive gas ions can impact upon and cause physical and chemical damage to the photocathode. Other gas atoms present within the pore 180 or proximate to the photocathode may be effective to chemically combine with and poison the photocathode.

In one embodiment, a barrier layer 186 is formed on the top of the first emissive layer 182. The barrier layer 186 forms a barrier between the first emissive layer 182 and the subsequent emissive layers. The resistance of the barrier layer 186 can be tailored to achieve certain performance, lifetime, and/or yield goals, such as achieving a predetermined current output of the microchannel plate. In some of these embodiments, the barrier layer 186 is a layer of semiconductor material that is deposited or grown over the first emissive layer 182. In one particular embodiment, the barrier layer 186 is metal oxide layer which is deposited by one of many deposition techniques known in the art.

In one embodiment, the barrier layer 186 is chosen to form a plurality of charge traps at a material interface between the first emissive layer 182 and a second emissive layer. When the charge traps are filled from the conductive layer, the charge traps provide both an enhanced source of electrons to replace secondary electrons emitted and an electric field enhancement that substantially increases the probability of electron escape, thereby increasing the secondary electron yield. For example, in embodiments using lead glass microchannel plates, the secondary electron emissive surface may include a thin film layer of $SiO_2$.

It is known in the art from research on MOS transistors that the addition of a second dielectric, such as $Al_2O_3$, to the $SiO_2$ gate dielectric results in an increase in the number of interface states located at the $SiO_2/Al_2O_3$ material interface. It is known that these interface states in MOS transistors serve as electron charge traps. It has been discovered that in microchannel plates, these charge traps alter the electric field within the pore structure, which serves to enhance the ability of the device to replenish the electron charge that escapes into pore as a result of the amplification process. Also, the occupied charge traps provide an enhanced electric field that substantially increases the probability that generated electrons escape and, therefore, increases the secondary electron yield. This charge trapping mechanism supports the enhanced secondary electron emission by allowing for timely electron replenishment and also improves device timing performance.

In addition, the pore 180 includes a second emissive layer 188 that is formed over the first emissive layer 182 or over the barrier layer 186. In various embodiments, the second emissive layer 188 can also be at least one of $Al_2O_3$, $SiO_2$, MgO, $SnO_2$, BaO, CaO, SrO, $Sc_2O_3$, $Y_2O_3$, $La_2O_3$, $ZrO_2$, $HfO_2$, $Cs_2O$, $Si_3N_4$, $Si_xO_yN_z$, C (diamond), BN, and AlN. In some embodiments, the thickness and material properties of the second emissive layer 188 are generally chosen to increase the secondary electron emission efficiency of the microchannel plate compared with conventional microchannel plates fabricated with single emissive layers. In some embodiments, the thickness and material properties of the second emissive layer 188 are generally chosen to provide a barrier to ion migration.

FIG. 1C illustrates a microchannel plate with first and second emissive layers 182, 188. However, one skilled in the art will understand that microchannel plates can be fabricated according to the present invention with any number of emissive layers. In embodiments including more than two emissive layers, there are many possible combinations of different emissive layer compositions and thicknesses. In addition, the multiple emissive layers can be stacked with or without conductive or resistive barrier layers.

The thickness and material properties of the second emissive layer (and subsequent emissive layers) can also be chosen to achieve certain performance, lifetime, and/or yield goals. In some embodiments, at least one of a thickness and a composition of the second emissive layer is chosen to maximize device performance parameters, such as the secondary electron emission efficiency and the signal-to-noise of the microchannel plate. Also, in some embodiments, at least one of a thickness and a composition of the second emissive layer 188 is chosen to optimize field uniformity of the microchannel plate to minimize image distortion across the microchannel plate.

Also, in one embodiment, at least one of the thickness and the composition of the second emissive layer is chosen to maximize the across field gain uniformity in the microchannel plate to reduce image distortion. There can be significant pore-to-pore differences in resistance and electron emission between adjacent pores. These differences are particularly significant in glass microchannel plates because the fibers used to define the pores are often manufactured at different times, which results in compositional differences that impact the individual pore performance (e.g. gain). The application of a second emissive film subjects all the pores within the microchannel plate device to the same process step, which results in more uniform pore-to-pore device performance. The second emissive film also results in improved total device performance because of the enhanced field uniformity and the reduced image distortion.

One aspect of the present invention is that the second emissive layer 188 can be formed directly over the first emissive layer 182. In this embodiment of the invention, the performance of any type of manufactured microchannel plate can be enhanced by using the methods of the present invention. That is, a second or multiple emissive layers can be formed on the pores of previously manufactured microchannel plates to enhance the microchannel plate's performance.

Experiments have shown that depositing $Al_2O_3$ on previously manufactured microchannel plates by atomic layer deposition (ALD) significantly enhances the performance of the microchannel plate. Atomic layer deposition has been shown to be effective in producing highly uniform, pinhole-free films having thickness that are as thin as a few Angstroms. Films deposited by ALD have relatively high quality and high film integrity compared with other deposition methods, such as physical vapor deposition (PVD), thermal evaporation, and chemical vapor deposition (CVD).

Atomic Layer Deposition (ALD) is a gas phase chemical process used to create extremely thin coatings. Atomic layer deposition is a variation of CVD that uses a self-limiting reaction. The term "self-limiting reaction" is defined herein to mean a reaction that limits itself in some way. For example, a self-limiting reaction can limit itself by terminating after a reactant is completely consumed by the reaction or once the reactive sites on the deposition surface have been occupied.

Atomic Layer Deposition reactions typically use two chemicals, which are sometimes called precursor chemicals. These precursor chemicals react with a surface one-at-a-time in a sequential manner. A thin film is deposited by repeatedly exposing the precursors to a growth surface. One method of ALD sequentially injects a pulse of one type of precursor gas into a reaction chamber. After a predetermined time, another pulse of a different type of precursor gas is injected into the reaction chamber to form a monolayer of the desired material. This method is repeated until a film having the desired thickness is deposited onto the growth surface.

Another aspect of the microchannel plates of the present invention is that the second emissive layer 188 and any other resistive and conductive layers formed on the first emissive layer 182 protect and passivate the first emissive layer 182. Emissive layers are easily damaged. In glass microchannel plates, the alkaline metals contained in the Pb-glass formulation are relatively stable in the bulk material. However, alkaline metals contained in the reduced lead silicate glass (RLSG) on the outer surface of the microchannels which forms the emissive layer are only loosely held within the film structure because their exposure to the high temperature hydrogen environment removes oxygen which breaks bonds in material structure. The electron bombardment that occurs during electron multiplication erodes these elements from the film. This erosion degrades the gain of the microchannel plate over time. In silicon microchannel plates, the emissive layer is typically a very thin coating that also erodes during electron bombardment which occurs during normal device operation.

Thus, in various embodiments, at least one of a thickness and a composition of the second emissive layer can be chosen to passivate the microchannel plate so that the number ions released from the microchannel plate is reduced. Reducing the number of ions released from the microchannel plate will improve the lifetime of the microchannel plate. Choosing the thickness and the composition of the second emissive layer to passivate the microchannel plate will also improve the process yield.

Yet another aspect of the microchannel plates of the present invention is that the first and second emissive layers 182, 188 can be optimized independently of each other. The first and second emissive layers 182, 188 can also be optimized independently of other microchannel plate parameters to achieve various performance, lifetime, and yield goals. For example, the secondary electron emission layers 182, 188 can be optimized separately to achieve high or maximum secondary electron emission efficiency or high or maximum lifetime. Such a microchannel plate can have significantly improved microchannel plate gain and lifetime performance compared with prior art microchannel plate devices.

The ability to independently optimize the various emissive layers is important because the performance of microchannel plates is determined by the properties of the combined emissive layers that form the continuous dynodes in the pores. The continuous dynodes must have emissive and conductive surface properties that provide at least three different functions. First, the continuous dynodes must have emissive surface properties desirable for efficient electron multiplication. Second, the continuous dynodes must have conductive properties that allow the emissive layer to support a current adequate to replace emitted electrons. Third, the continuous dynodes must have conductive properties that allow for the establishment of an accelerating electric field for the emitted electrons.

Maximizing the generation of secondary electrons in the emissive layer of known microchannel plates may result in an emissive layer with too high of a resistance to adequately support the current necessary to replace emitted electrons or too low of a resistance to establish an accelerating electric field capable of emitting electrons. That is, the resistance necessary to achieve conductive properties that allow the combined emissive layer to support a current which is adequate to replace emitted electrons and, which is adequate to establish an accelerating electric field for the emitted electrons, is not typically the resistance values which maximize the secondary electron emission.

Consequently, the performance of these three functions, emitting secondary electrons, replacing emitted electrons, and establishing an accelerating electric field for the emitted electrons, can not typically be simultaneously maximized with a single emissive layer. Thus, in prior art single emissive layer microchannel plate devices, the secondary emission properties of the emissive layer can not be optimized to maximize secondary electron emission and, therefore, can not be optimized to maximize the sensitivity performance of the microchannel plates. In fact, most known microchannel plates are fabricated to optimize the resistance of the emissive layer rather than to optimize the secondary electron emission. The method of the present invention allows the various emissive layers to be independently optimized for one or more performance, lifetime or yield goal.

Figure 2A:
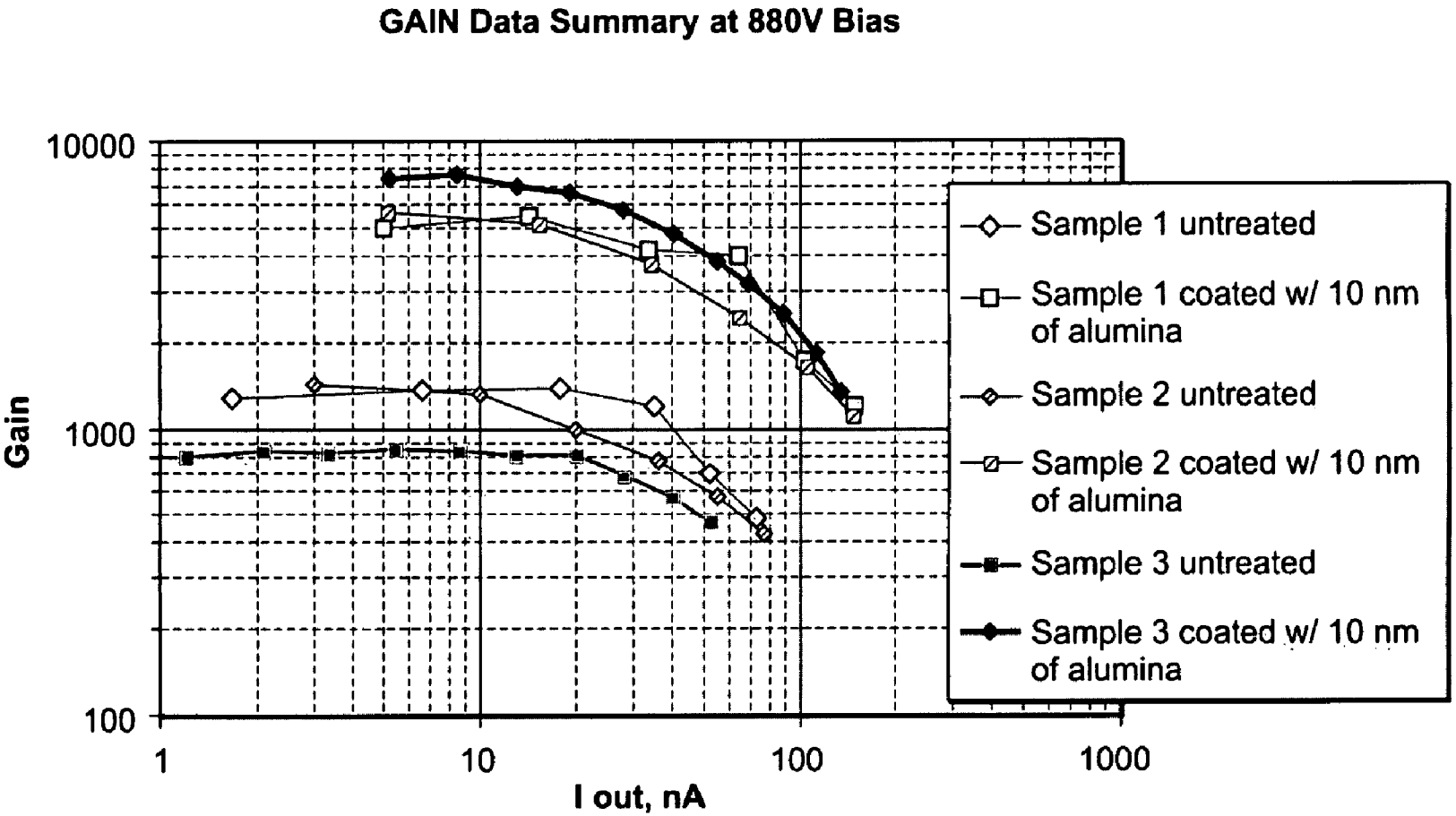
FIG. 2A illustrates experimental results comparing gain as a function of output current for conventional microchannel plates and for microchannel plates fabricated having first and second emissive layers according to the present invention.

FIG. 2A illustrates experimental results comparing gain as a function of output current for conventional microchannel plates and for microchannel plates having first and second emissive layers according to the present invention. The data shown in FIG. 2A for the conventional microchannel plates having a single emissive layer was taken with manufactured microchannel plate devices that are commonly used in night vision devices. Data for the microchannel plate devices having first and second emissive layers according to the present invention were taken with the same manufactured microchannel plate devices that were further processed by the methods of the present invention to form a second emissive layer. One feature of the microchannel plates of the present invention is that multiple emissive layers can be formed on complete manufactured off-the-shelf devices to enhance the performance of these microchannel plate devices.

Data is presented for three different similarly manufactured microchannel plate devices. The similarly manufactured microchannel plate devices have pore diameters equal to about 4.8 microns, microchannel plate thicknesses equal to about 240 microns, and ratios of pore length-to-pore diameter equal to about 50. The similarly manufactured microchannel plates were biased at 880 Volts during operation. Gain data is presented as a function of output current in nanoamps for the three different similarly manufactured microchannel plate devices with single emissive layers. The average gain was determined to be about 800.

The three similarly manufactured microchannel plates where then further processed by the methods of the present invention to form a second emissive layer. A ten nanometer $Al_2O_3$ emissive layer was formed directly on the original single emissive layer of the similarly manufactured microchannel plates. Gain data is presented as a function of output current in nanoamps for the three similarly manufactured microchannel plate devices with second emissive layers formed according to the present invention. The average gain was determined to be about 7,500. Therefore, the second emissive layer according to the present invention provided a gain multiplier of about 9.4.

Similar experiments were preformed with a second type of microchannel plate device, which is commercially available. This second type of microchannel plate device has relatively large dimensions compared with the first type of microchannel plate device. The second type of microchannel plate device was manufactured to have microchannel plate pore diameters equal to about 10 microns, microchannel plate thicknesses equal to about 400 microns, and ratios of pore length-to-pore diameter equal to about 40. The second type of microchannel plate device was measured to have an off-the-shelf gain of about 22,000.

Three of the second type of microchannel plate devices were then further processed by the methods of the present invention to form a second emissive layer. A ten nanometer $Al_2O_3$ emissive layer was formed directly on the original emissive layer in the microchannel plate devices. Gain data is presented as a function of output current in nanoamps for the second type of microchannel plate devices with second emissive layers formed according to the present invention. The average gain was determined to be about 235,000. Therefore, the second emissive layer provided a gain multiplier of about 10.7.

Figure 2B:
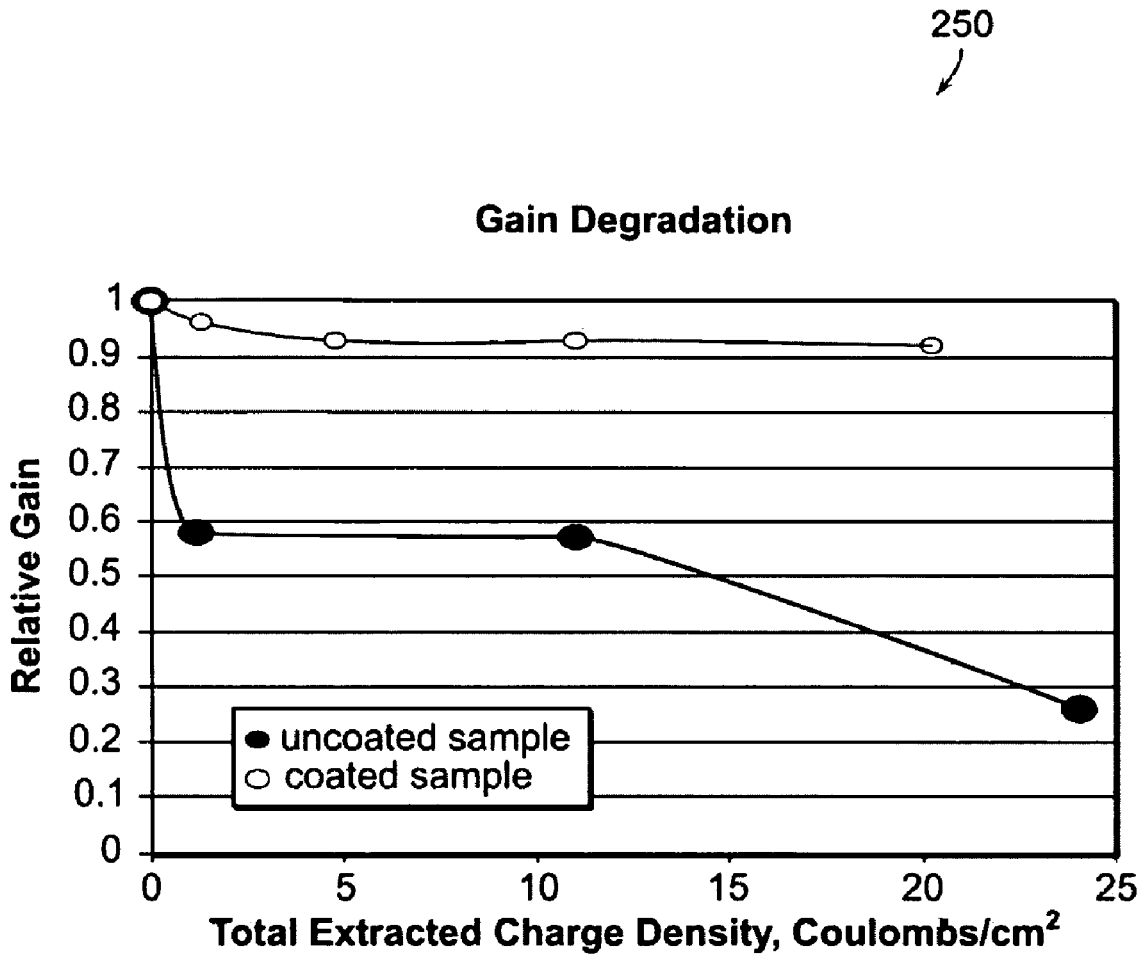
FIG. 2B illustrates gain degradation data resulting from extracted charge for conventional microchannel plates with a single emissive layer and for microchannel plates fabricated with a second emissive layer according to the present invention.

FIG. 2B illustrates gain degradation data 250 resulting from extracted charge for conventional microchannel plates with a single emissive layer and for microchannel plates with a second emissive layer fabricated according to the present invention. The gain degradation data were acquired for microchannel plate devices operating with a 90 fA/pore input current and a 1,000V bias. The bias current for the conventional microchannel plates with the single emissive layer was about 12.5 μA and the bias current for the microchannel plates with a second emissive layer according to the present invention was about 14.5 μA.

Relative gain data was plotted as a function of the total extracted charge density in coulombs/cm2. The relative gain degradation data 250 indicate that there is significantly less gain degradation for microchannel plates having a second emissive layer fabricated according to the present invention as a function of the total extracted charge. The gain degradation data indicates that the second emissive layer can significantly increase the lifetime of the microchannel plates.

Figure 2C:
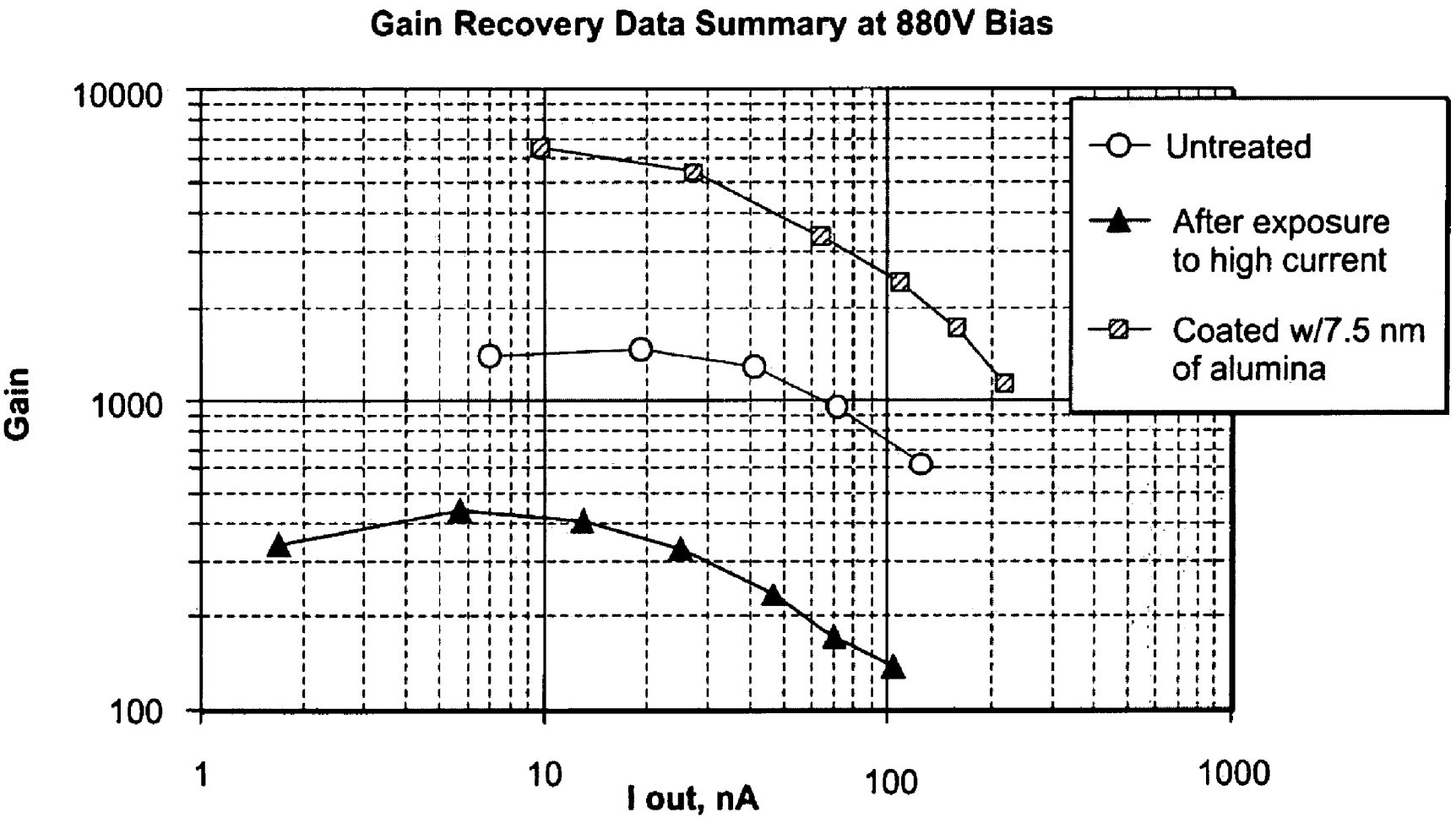
FIG. 2C illustrates a plot of gain recovery data for microchannel plates fabricated with a second emissive layer according to the present invention.

FIG. 2C illustrates a plot of gain recovery data for microchannel plates with a second emissive layer according to the present invention. The gain data is presented for a manufactured microchannel plate having a conventional single emissive layer that is commonly used in night vision devices. In addition, gain data is presented for the same manufactured microchannel plate device after an initial burn-in period where the device is exposed to a high current. The total extracted charge during the burn-in period over an input current step whose maximum value resulted in a 10 μA output current (which is approximately ten times the device strip current) was about 0.01 Coulombs. Comparison of the gain data indicate a significant drop in gain resulting from the operation during the burn-in period.

In addition, gain recovery data is presented for the same manufactured microchannel plate device after a second emissive layer is fabricated according to the present invention. The second emissive layer was an $Al_2O_3$ layer that was approximately 7.5 nm thick. The data indicate that the resulting gain is significantly higher than the gain of the originally manufactured device. Therefore, forming the second emissive layer according to the present invention resulted in repairing or "healing" the degraded microchannel plate device and a significant improvement in the original gain.

Figure 3:
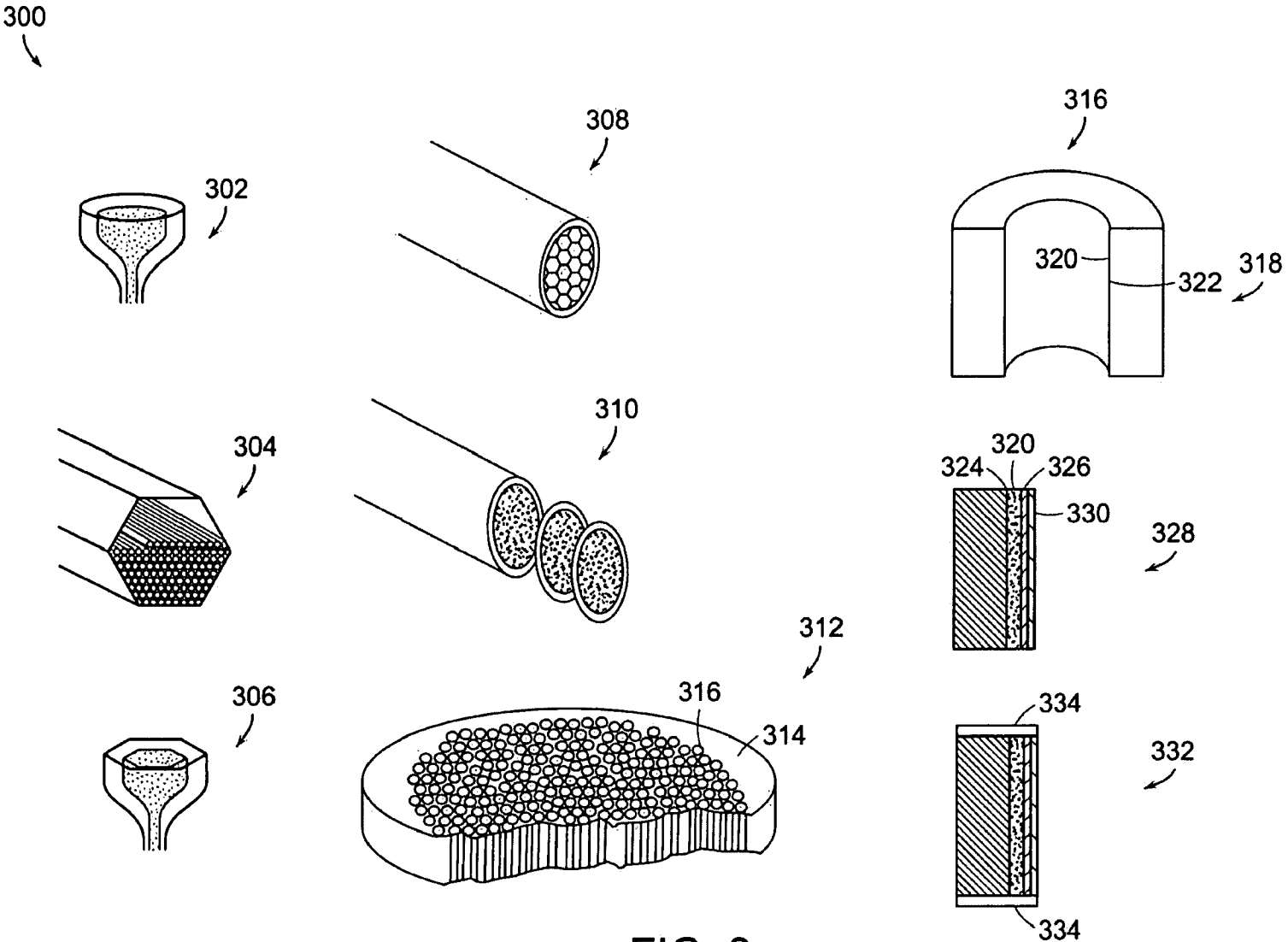
FIG. 3 illustrates a method of fabricating a glass microchannel plate fabricated with a first and second emissive layer according to the present invention.

FIG. 3 illustrates a method 300 of fabricating a glass microchannel plate with a first and second emissive layer according to the present invention. The method 300 uses a glass multi-fiber draw (GMD) process that is commonly used to form conventional glass microchannel plates with a single secondary emission layer. See, for example, Microchannel Plate Detectors, Joseph Wiza, Nuclear Instruments and Methods, Vol. 162, 1979, pages 587-601, for a detailed description of the GMD process.

The fabrication of glass microchannel plates begins with a plurality of individual composite fibers made of specially formulated lead-glass. For example, in one embodiment, the individual composite fibers include barium borosilicate core glass that is surrounded by an alkali lead silicate cladding glass.

In a first step 302, a plurality of fibers is drawn down a rod-in-tube preform by well known methods. In a second step 304, the individual composite fibers are packed together in an array. In various embodiments, the array can be a hexagonal array or a rectangular array. In a third step 306, the packed array of individual composite fibers is then redrawn into multi-fiber bundles. In a fourth step 308, the multi-fiber bundles are stacked together and fused within a glass envelope to form a solid boule. In a fifth step 310, the solid boule is then sliced to form plates. The resulting plates are then edged and polished. In a sixth step 312, the soluble core glass is then removed by a chemical etch, thereby producing a microchannel plate 314 containing an array of microchannels 316.

In a seventh step 318, the microchannel plate 314 containing the array of microchannels 316 is exposed to a hydrogen reduction environment that produces an emissive layer 320 of reduced lead silicate glass (RLSG) on the outer surface 322 of the microchannels 316. The RLSG emissive layer 320 forms a continuous dynode in the microchannels. In the seventh step 318, the time and temperature of the hydrogen reduction process are both precisely controlled so that the RLSG emissive layer 320 on the outer surface 322 of the microchannels 316 has the desired conductive surface properties for the required electron multiplication.

In some embodiments, a thin barrier layer 324 is deposited on the outer surface 322 of the microchannels 316 prior to exposing the microchannels to the hydrogen reduction environment that produces the emissive layer 320 of reduced lead silicate glass (RLSG) on the outer surface 322 of the microchannels. The composition and thickness of the thin barrier layer 324 can be chosen to increase the secondary electron efficiency of the microchannel plate or to achieve a certain microchannel plate current.

In some embodiments, a thin resistive or conductive barrier layer 326 is deposited on the first emissive layer 320. In these embodiments, the thickness and composition of the thin resistive or conductive barrier layer 326 can be tailored to maximize or to achieve a specific output current of the microchannel plate.

In an eighth step 328, a second emissive layer 330 is deposited onto the RLSG emissive layer 320 or, in some embodiments, onto the barrier layer 326. The composition and thickness of the second emissive layer 330 is chosen to increase the secondary electron emission efficiency of the microchannel plate. In various specific embodiments, the second emissive layer 330 can be at least one of $Al_2O_3$, $SiO_2$, MgO, $SnO_2$, BaO, CaO, SrO, $Sc_2O_3$, $Y_2O_3$, $La_2O_3$, $ZrO_2$, $HfO_2$, $Cs_2O$, $Si_3N_4$, $Si_xO_yN_z$, C (diamond), BN, and AlN. Microchannel plates fabricated according to the method of the present invention with second emissive layers comprising $Al_2O_3$ have been found to have high secondary electron emission efficiency.

The second emissive layer 330 can be deposited by any method for depositing a conformal coating in a high aspect-ratio substrate, such as by atomic layer deposition as described herein above. In various embodiments, at least one of the thickness and the composition of the second emissive layer is chosen to increase the secondary electron emission efficiency of the microchannel plate compared with a prior art microchannel plate with a single emissive layer. The thickness and the composition of the second emissive layer can also be chosen to achieve a certain microchannel plate output current.

In the ninth step 332, metal electrodes 334 are deposited on the top and the bottom surface of the microchannel plate to provide electrical contacts for the microchannel plate. The metal electrodes 334 can be deposited by various means, such as by chemical vapor deposition, atomic layer deposition, or any of numerous other deposition techniques known in the art.

Referring to FIG. 1C and FIG. 3, in one embodiment, the metal electrodes 334 are deposited on the top and the bottom surface of the microchannel plate prior to depositing the second emissive layer 330 onto the RLSG emissive layer 320. However, in other embodiments, the second emissive layer 330 is deposited onto the RLSG emissive layer 320 prior to depositing the metal electrodes 334 on the top and the bottom surface of the microchannel plate.

The methods of the present invention described in connection with FIG. 1C and FIG. 3 can also be used to fabricate single channel electron multipliers with enhanced performance, such as the single channel electron multiplier described in FIG. 1B. In particular, single channel electron multipliers can be fabricated with a second emissive layer as described herein above.

EQUIVALENTS

While the present teachings are described in conjunction with various embodiments and examples, it is not intended that the present teachings be limited to such embodiments. On the contrary, the present teachings encompass various alternatives, modifications and equivalents, as will be appreciated by those of skill in the art, may be made therein without departing from the spirit and scope of the invention.

What is claimed is:

1. A method of fabricating a microchannel plate, the method comprising:

a. defining a plurality of pores extending from a top surface of a substrate to a bottom surface of the substrate, the plurality of pores having a resistive material on an outer surface that forms a first emissive layer;

b. forming a second emissive layer over the first emissive layer, the second emissive layer having a different material composition than the first emissive layer and being chosen to achieve at least one of an increase in secondary electron emission efficiency and a decrease in gain degradation as a function of time;

c. forming a top electrode on the top surface of the substrate; and d. forming a bottom electrode on the bottom surface of the substrate.

2. The method of claim 1 wherein the first emissive layer comprises at least one of $Al_2O_3$, $SiO_2$, MgO, $SnO_2$, BaO, CaO, SrO, $Sc_2O_3$, $Y_2O_3$, $La_2O_3$, $ZrO_2$, $HfO_2$, $Cs_2O$, $Si_3N_4$, $Si_xO_yN_z$, C (diamond), BN, and AlN.

3. The method of claim 1 wherein the second emissive layer comprises at least one of $Al_2O_3$, $SiO_2$, MgO, $SnO_2$, BaO, CaO, SrO, $Sc_2O_3$, $Y_2O_3$, $La_2O_3$, $ZrO_2$, $HfO_2$, $Cs_2O$, $Si_3N_4$, $Si_xO_yN_z$, C (diamond), BN, and AlN.

4. The method of claim 1 wherein the top and bottom electrodes are formed before forming the second emissive layer over the first emissive layer.

5. The method of claim 1 wherein the top and bottom electrodes are formed after forming the second emissive layer over the first emissive layer.

6. The method of claim 1 further comprising depositing a barrier layer over the first emissive layer before forming the second emissive layer.

7. The method of claim 1 further comprising depositing a barrier layer over the second emissive layer.

8. The method of claim 1 further comprising selecting at least one of a thickness and a composition of the second emissive layer to maximize the secondary electron emission efficiency of the microchannel plate.

9. The method of claim 1 further comprising selecting at least one of a thickness and a composition of the second emissive layer to passivate the plurality of pores so that a number of ions released from the plurality of pores is reduced.

10. The method of claim 1 further comprising selecting at least one of a thickness and a composition of the second emissive layer to maximize a signal-to-noise of the microchannel plate.

11. The method of claim 1 further comprising selecting at least one of a thickness and a composition of the second emissive layer to optimize electric field uniformity of the microchannel plate so as to reduce image distortion.

12. The method of claim 1 further comprising selecting at least one of a thickness and a composition of the second emissive layer to form a plurality of charge traps at a material interface between the first and second emissive layers.

13. The method of claim 1 further comprising selecting at least one of a thickness and a composition of the second emissive layer to form a plurality of charge traps at a material interface between the first and second emissive layers, the plurality of charge traps establishing an electric field that increases secondary electron emission efficiency.

14. A method of fabricating a single channel electron multiplier, the method comprising:

a. defining a single channel extending from a top surface of a substrate to a bottom surface of the substrate, the single channel having a resistive material on an outer surface that forms a first emissive layer;

b. depositing a second emissive layer over the first emissive layer, the second emissive layer having a different material composition than the first emissive layer and being chosen to achieve at least one of an increase in secondary electron emission efficiency and a decrease in gain degradation as a function of time;

c. forming a top electrode on the top surface of the substrate; and d. forming a bottom electrode on the bottom surface of the substrate.

15. The method of claim 14 wherein the second emissive layer comprises at least one of $Al_2O_3$, $SiO_2$, MgO, $SnO_2$, BaO, CaO, SrO, $Sc_2O_3$, $Y_2O_3$, $La_2O_3$, $ZrO_2$, $HfO_2$, $Cs_2O$, $Si_3N_4$, $Si_xO_yN_z$, C (diamond), BN, and AlN.

16. A method of fabricating a microchannel plate, the method comprising:

a. drawing a plurality of solid glass fibers, each of the plurality of solid glass fibers comprising a core glass fiber, which is soluble in an etchant, and lead glass cladding that surrounds the core glass fiber, which is not soluble in the etchant;

b. packing the plurality of glass fibers in an array;

c. drawing the packed glass fibers;

d. fusing the drawn packed glass fibers within a glass envelope, thereby forming a boule of packed glass fibers;

e. slicing the boule of packed glass fibers, thereby forming a plate of packed glass fibers;

f. exposing the core glass to the etchant, thereby removing the core glass so that the lead cladding defines a plurality of pores through the plate of packed glass fibers;

g. reducing the lead glass cladding at the surfaces of the plurality of pores in a hydrogen atmosphere to semiconducting lead, thereby forming a first emissive layer at the surfaces of the plurality of pores; and h. depositing a second emissive layer over the first emissive layer, the second emissive layer having a different material composition than the first emissive layer and being chosen to increase a secondary electron emission efficiency of the microchannel plate.

17. The method of claim 16 wherein the depositing the second emissive layer comprises depositing the second emissive layer using atomic layer deposition.

18. The method of claim 16 wherein the depositing the second emissive layer comprises depositing the second emissive layer by at least one of physical vapor deposition (PVD), thermal evaporation, and chemical vapor deposition (CVD).

19. The method of claim 16 wherein the depositing the second emissive layer comprises depositing at least one of $Al_2O_3$, $SiO_2$, MgO, $SnO_2$, BaO, CaO, SrO, $Sc_2O_3$, $Y_2O_3$, $La_2O_3$, $ZrO_2$, $HfO_2$, $Cs_2O$, $Si_3N_4$, $Si_xO_yN_z$, C (diamond), BN, and AlN.

20. The method of claim 16 further comprising depositing a top electrode on a top surface of the plate and a bottom electrode on a bottom surface of the plate.

21. The method of claim 20 wherein at least one of the top and bottom electrodes are deposited before the depositing of the second emissive layer on the first emissive layer.

22. The method of claim 20 wherein at least one of the top and bottom electrodes are deposited after the depositing the second emissive layer on the first emissive layer.

23. The method of claim 16 further comprising depositing a resistive layer on the first emissive layer before the depositing of the second emissive layer.

24. The method of claim 16 further comprising selecting at least one of a thickness and a composition of the second emissive layer to maximize the secondary electron emission efficiency of the microchannel plate.

25. The method of claim 16 further comprising depositing a conducting layer on an outer surface of the plurality of pores before reducing the lead glass cladding material at the surfaces of the plurality of pores.

* * * * *